US009650776B2

(12) United States Patent
Kashirajima et al.

(10) Patent No.: US 9,650,776 B2
(45) **Date of Patent: *May 16, 2017**

(54) FLUSH TOILET

(71) Applicant: TOTO LTD., Kitakyushu-shi, Fukuoka (JP)

(72) Inventors: Shu Kashirajima, Kitakyushu (JP); Masaki Kitamura, Kitakyushu (JP); Satoshi Yamakawa, Kitakyushu (JP); Kazuyoshi Mizoguchi, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/068,561

(22) Filed: Mar. 12, 2016

(65) Prior Publication Data

US 2016/0273206 A1 Sep. 22, 2016

(30) Foreign Application Priority Data

Mar. 18, 2015 (JP) ..... 2015-054762

(51) Int. Cl.

| | |
|---|---|
| ***E03D 11/06*** | (2006.01) |
| ***A47K 13/00*** | (2006.01) |
| ***E03D 11/08*** | (2006.01) |
| ***E03D 11/13*** | (2006.01) |
| ***E03D 1/00*** | (2006.01) |

(52) U.S. Cl.

CPC ..... *E03D 11/06* (2013.01); *A47K 13/00* (2013.01); *E03D 1/00* (2013.01); *E03D 11/08* (2013.01); *E03D 11/13* (2013.01)

(58) Field of Classification Search

CPC ..... E03D 11/02
USPC ..... 4/300–442
See application file for complete search history.

(56) References Cited

U.S. PATENT DOCUMENTS

| | | | |
|---|---|---|---|
| 3,593,349 | A | 7/1971 | Bungo |
| 2003/0088910 | A1 | 5/2003 | Hidetaka et al. |
| 2010/0251471 | A1 | 10/2010 | Cadavid Gonzalez et al. |
| 2012/0198610 | A1 | 8/2012 | McHale et al. |

OTHER PUBLICATIONS

Extended European Search Report for European Application No. EP 16160458.2, Completed by the European Patent Office, Dated Jul. 22, 2016, 11 Pages.

*Primary Examiner* — Lori Baker
(74) *Attorney, Agent, or Firm* — Brooks Kushman P.C.

(57) ABSTRACT

A flush toilet wherein at least a portion of the exterior part of an exterior member installed on a rim portion can be easily installed and registered at the height of the rim outer wall upper sloped surface, and seen from the toilet lateral direction, the border between at least a part of the exterior part of the exterior member and the rim outer wall upper sloped surface appears as a single aligned straight line, imparting an aesthetic impression to the user. The rim portion of the flush toilet of the invention includes a rim outer wall upper sloped surface being positioned in an outside of an upper region of the rim outer wall portion, and at least a portion of the exterior part is disposed at the height of the rim outer wall upper sloped surface.

9 Claims, 11 Drawing Sheets

FLUSH TOILET

CROSS-REFERENCE TO RELATED APPLICATIONS

This application claims priority to JP application JP 2015-054762 filed on, Mar. 18, 2015, the disclosure of which is incorporated in its entirety by reference herein.

TECHNICAL FIELD

The present invention pertains to a flush toilet, and more particularly to a flush toilet for discharging waste by flushing a toilet main unit using flush water supplied from a flush water source.

BACKGROUND

As disclosed in Patent Document 1 (U.S. Pat. No. 4,941,796), a water conduit is formed at the rear upper portion of a toilet main unit to spout flush water supplied from a storage tank into a bowl portion, and a rim portion is formed along the top edge portion of the bowl portion over this water conduit. In this rim portion, an inner edge portion formed on the inside of the toilet main unit, and an outside edge portion formed on the outside of the toilet main unit are formed in essentially the same angular shape.

SUMMARY

Technical Problem

In such conventional flush toilets, because of the requirement that the toilet lid bottom edge portion 160 and rim outer wall portion 156 generally not contact, as shown in FIG. 11, the toilet lid bottom edge portion 160 is disposed outside and above the rim outer wall portion 156. Therefore a gap C is formed between the toilet lid bottom edge portion 160 and the rim top surface portion 154.

In such cases, the problem arose that when a user viewed the toilet from the side, the gap C formed between the toilet lid bottom edge portion 160 and the rim outer wall portion 156 was visible, and the boundary did not appear as a single line.

A further problem was that because an unevenness 154*a* is visible on the rim top surface portion 154 in the gap C, and the boundary between the toilet lid bottom edge portion 160 and the rim top surface portion 154 appears as an uneven line, the user cannot be shown a single aligned straight line, and an aesthetic impression cannot be imparted to users.

The present invention therefore has the object of providing a flush toilet with which, when installing an exterior member on a rim portion, at least a part of the exterior part of the exterior member can be easily installed and registered at the height of the rim outer wall upper sloped surface, and seen from the toilet lateral direction, the border between at least a part of the exterior part of the exterior member and the rim outer wall upper sloped surface appears as a single aligned straight line, imparting an aesthetic impression to the user.

Solution to Problem

To achieve the above-described object, the invention is a flush toilet comprising: a bowl portion including a bowl-shaped waste receiving surface and a rim portion formed on a top edge of the waste receiving surface; a water discharge path for discharging waste, the water discharge path having an inlet that is connected at a bottom of this bowl portion; a water spouting portion for spouting flush water to the bowl portion to generate a circulating current; a water conduit for supplying flush water to the water spouting portion; and an exterior member including an exterior part disposed over the rim portion; wherein the rim portion comprises a rim outer wall portion forming an outer perimeter of the rim portion, and a rim inner wall portion forming the inner perimeter of the rim portion; the rim outer wall portion comprises a rim outer wall upper sloped surface being positioned in an outside of an upper region of the rim outer wall portion and being sloped downward toward an outer of the bowl portion; and at least a part of the exterior part is disposed at the height of the rim outer wall upper sloped surface.

In the invention thus constituted, the rim portion comprises a rim outer wall upper sloped surface being positioned in an outside of an upper region of the rim outer wall portion and being sloped downward toward an outer of the bowl portion, therefore at least a part of the exterior part of the exterior member installed on the rim portion can be easily installed and registered at the height of the rim outer wall upper sloped surface; moreover, seen from the side of the toilet the boundary between at least a part of the exterior part of the exterior member and the rim outer wall upper sloped surface appears to be a single straight aligned line, and aesthetic impression can be imparted to the user.

In the present invention the rim inner wall portion preferably further comprises a rim inner wall upper sloped surface being positioned in an inside of an upper region of the rim inner wall portion and being sloped downward toward an inner of the bowl portion, and in at least a part of an entire perimeter of the rim portion, a horizontal distance between an top end of the rim inner wall upper sloped surface and a bottom end of the rim inner wall upper sloped surface is formed to be longer than a horizontal distance between an top end of the rim outer wall upper sloped surface and a bottom end of the rim outer wall upper sloped surface.

In the invention thus constituted, a horizontal distance between an top end of the rim inner wall upper sloped surface and a bottom end of the rim inner wall upper sloped surface is formed to be longer than a horizontal distance between an top end of the rim outer wall upper sloped surface and a bottom end of the rim outer wall upper sloped surface in at least a part of an entire perimeter of the rim portion, therefore when a user wipes clean the rim portion, the rim portion upper part, the rim inner wall upper sloped surface, and the rim inner wall portion can be efficiently cleaned with the user's own hand placed so as to follow from the rim portion upper portion up to the rim portion inner wall so as to follow along the sloping surface of the rim inner wall upper sloped surface from the upper part of the rim portion.

In addition, because cleaning can be performed while applying a relatively uniform force from the rim portion top surface to the rim inner wall upper sloped surface and rim inner wall portion, the user can easily impart a relatively strong force to the entirety of the rim portion to be wiped clean, so that cleaning performance can be improved.

In the present invention a bottom end of the rim inner wall upper sloped surface is preferably disposed above a top end of the spouting portion.

In the invention thus constituted, flush water spouted from the spouting portion is circulated along a region below a bottom end of the rim inner wall upper sloped surface, therefore flush water can be constrained from passing over the rim inner wall upper sloped surface and splashing outside the toilet. Because flush water is circulated in this manner along a region below the bottom end of the rim inner wall upper sloped surface, the width and size, etc. of the rim inner wall upper sloped surface can be formed to be relatively large.

In the present invention, preferably, the rim inner wall upper sloped surface is formed in an arc shape; the rim inner wall upper sloped surface is formed in an arc shape; and a ratio between the radius of the arc forming the rim outer wall upper sloped surface and the arc forming the rim inner wall upper sloped surface is formed in a ranges from 1:2 to 1:5 inclusive.

In the invention thus constituted, the radius of the arc forming the rim inner wall upper sloped surface is formed to be easily grasped by the bend in a user's hand. It is therefore easy for the user's own hand to follow the arc shape forming the rim inner wall upper sloped surface when wiping clean the rim portion.

In the present invention, preferably, the rim portion is formed so that at least a portion of the rim inner wall portion is overhangs inwardly.

In the invention thus constituted, when transporting the toilet, installers, manufacturers, and the like can carry the toilet in a favorable manner by placing hands on the rim portion formed with overhangs, with hands gripping.

In the present invention, preferably, an outlet of the spouting portion is formed in a front region of the bowl portion such that the flush water swirls from the front end of the bowl portion toward a rear of the bowl portion to generate the circulating current.

In the invention thus constituted, the spouting portion can form a circulating current flowing rearward from the front end of the bowl portion, sufficiently flushing the bowl portion while conserving water.

In the present invention, preferably, the spouting portion is formed to spout to the front of the bowl portion, the rim portion has an upper portion that overhangs inwardly being disposed on the front side of an outlet of the spouting portion.

In the invention thus constituted, from the bowl portion spouting portion to the front side region where flush water spouted from the spouting portion can easily pass over the rim portion and splash outside the toilet, the rim portion has an upper portion that overhangs inwardly being disposed on the front side of an outlet of the spouting portion, therefore splashing of flush water outside the toilet can be constrained.

In the present invention, preferably, the flush water supplied to the water conduit by a flush water supply apparatus using water utility supply pressure from a flush water source.

In the invention thus constituted, the strength of the surge of flush water supplied by a flush water supply apparatus using water utility supply pressure from a flush water source during spouting can be relatively constrained. Therefore it is more difficult for flush water spouted from the spouting portion to pass from the bowl over the rim portion and splash, and the width of the rim inner wall upper sloped surface can be made large.

In the present invention, preferably, a bottom end of at least a portion of the external part is disposed at a height lower than the height of the top surface of the rim portion.

In the invention thus constituted, the rim portion comprises a rim outer wall upper sloped surface in which the outside of the upper region of the rim outer wall slopes downward, and a bottom end of at least a portion of the external part is disposed at a height lower than the height of the top surface of the rim portion, therefore at least a portion of the external part of the exterior member can be disposed at the height of the rim outer wall upper sloped surface.

Advantageous Effects of Invention

Using the flush toilet of the present invention, when installing an exterior member on a rim portion at least a part of the exterior part of the exterior member can be easily installed and registered at the height of the rim outer wall upper sloped surface, and seen from the toilet lateral direction, the border between at least a part of the exterior part of the exterior member and the rim outer wall upper sloped surface appears as a single aligned straight line, imparting an aesthetic impression to the user.

DETAILED DESCRIPTION

Next, referring to the attached drawings, we explain a flush toilet according to an embodiment of the invention.

Figure 1:
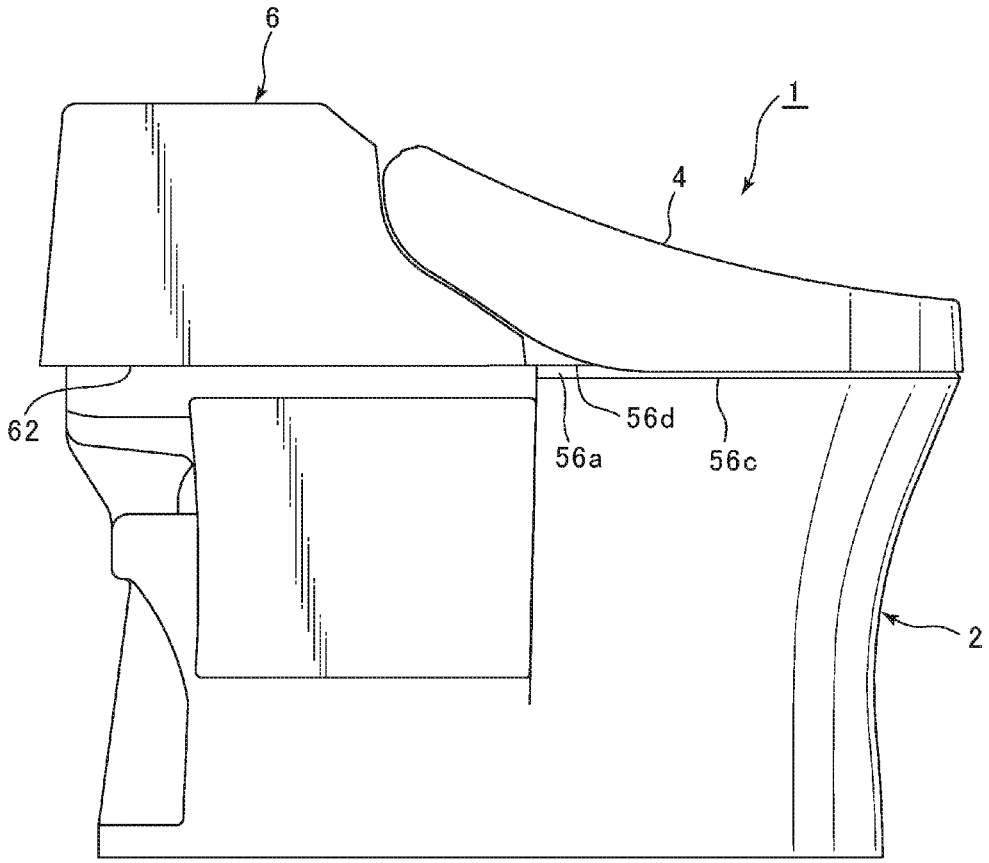
FIG. 1 is a side elevation seen from the side of a toilet main unit, functional portion, and toilet lid in a flush toilet according to an embodiment of the invention.
Figure 2:
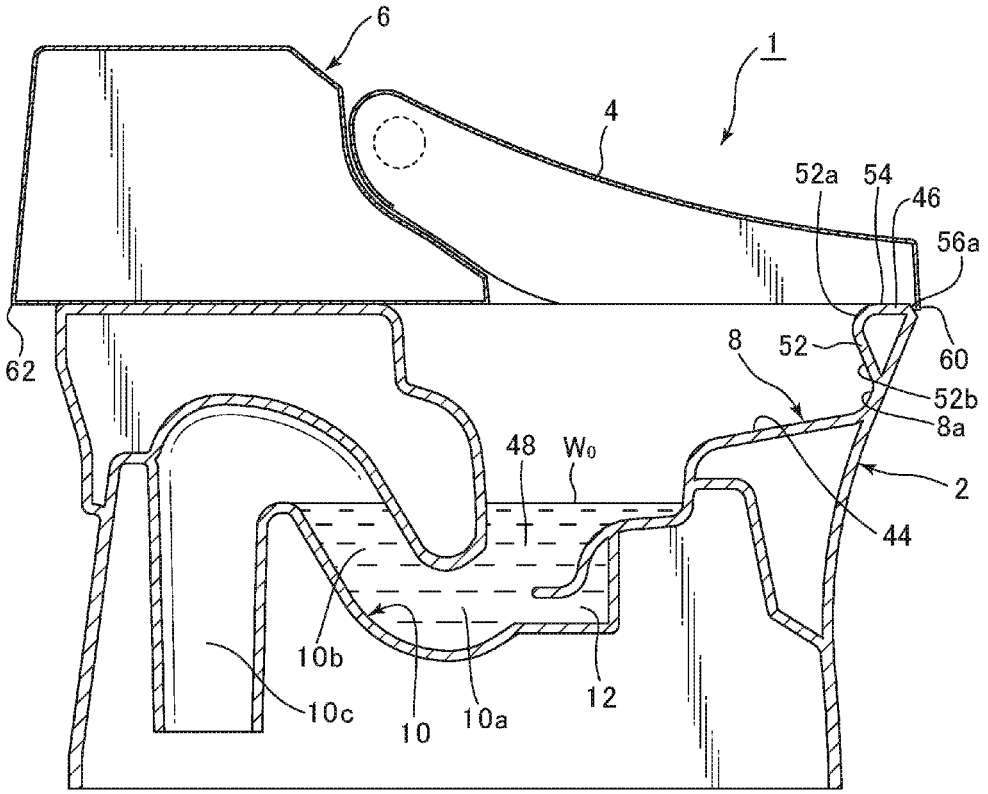
FIG. 2 is a cross section showing the interior of a flush toilet according to an embodiment of the invention along a center cross section.

First, using FIGS. 1 and 2, we explain the structure of a flush toilet according to an embodiment of the invention.

Here, FIG. 1 is a side elevation seen from the side of a toilet main unit, functional portion, and toilet lid in a flush toilet according to an embodiment of the invention; FIG. 2 is a cross section showing the interior of a flush toilet according to an embodiment of the invention along a center cross section.

As shown in FIGS. 1 and 2, the flush toilet 1 according to an embodiment of the invention comprises a flush toilet 1, a toilet main unit 2, a toilet seat (not shown) disposed on the top surface of this toilet main unit 2, a toilet lid 4 disposed so as to cover the toilet seat, and a functional portion (water supply apparatus) 6 disposed at the rear of the toilet main unit 2.

In the present invention the toilet lid 4 and the functional portion 6 form an exterior member which primarily defines the exterior appearance of the upper portion of the toilet main unit 2. Note that in other embodiments it is also acceptable for the toilet lid 4 to be omitted, and the toilet seat (not shown) and functional portion 6 to form the exterior member primarily defining the external appearance of the upper portion of the toilet main unit 2. In other embodiments it is also acceptable for at least one of either the toilet lid 4 or the functional portion 6 to form the exterior member primarily defining the external appearance of the upper portion of the toilet main unit 2.

The toilet main unit 2 is made of ceramic, and a bowl portion 8 for receiving waste, a discharge trap conduit 10 (discharge path) extending from the bottom portion of this bowl portion 8, a jet spout port 12 for jet spouting water, and a single rim spout port 14 (spouting portion) for rim spouting are formed on the toilet main unit 2.

The jet spout port 12 is formed at the bottom portion of the bowl portion 8; it is disposed essentially horizontally toward the inlet of the discharge trap conduit 10, and ejects water toward the discharge trap conduit 10.

A rim spout port 14 is formed at the left upper rear of the bowl portion 8; it ejects flush water along the edge of the bowl portion 8.

Note that while in the present embodiment a jet spout port 12 is formed on the toilet main unit 2, the present invention is not limited to such a form and, for example, it is also acceptable for only a rim spout port to be formed of the jet spout portion and the rim spout port, with no jet spout port being formed.

The discharge trap conduit 10 is made up of an inlet portion 10*a*, a trap ascending pipe 10*b* rising from this inlet portion 10*a*, and a trap descending pipe 10*c* dropping from this trap ascending pipe 10*b*.

The flush toilet 1 according to the present embodiment is directly connected to a water utility supplying flush water; flush water is ejected from the rim spout port 14 by the water utility supply pressure. With respect to jet spouted water, as described below, flush water stored in a water storage tank 28 built into the functional portion 6 is pressurized by a pressuring pump 30 and ejected from a jet spout port 12 at a high flow rate.

The flush toilet 1 in the present embodiment is a hybrid flush toilet having a hybrid (water utility direct pressure+ tank supply) water supply apparatus whereby with respect to rim spouting, the toilet is flushed by supplying water using water utility water pressure (water utility direct pressure supply), and with respect to jet spouting, flush water stored in the water storage tank 28 is pressurized by the pressurizing pump 30 and ejected from the jet spout port 12.

Note that the flush toilet 1 functional portion 6 may also be applied for purposes other than a hybrid water supply apparatus. For example, a water utility direct pressure type of flush toilet comprising only a water utility direct pressure type of water supply apparatus whereby water is supplied using water utility water pressure, or a flush toilet in which water is supplied by a flush valve system, or by using supplementary pump pressure, is also acceptable.

Figure 3:
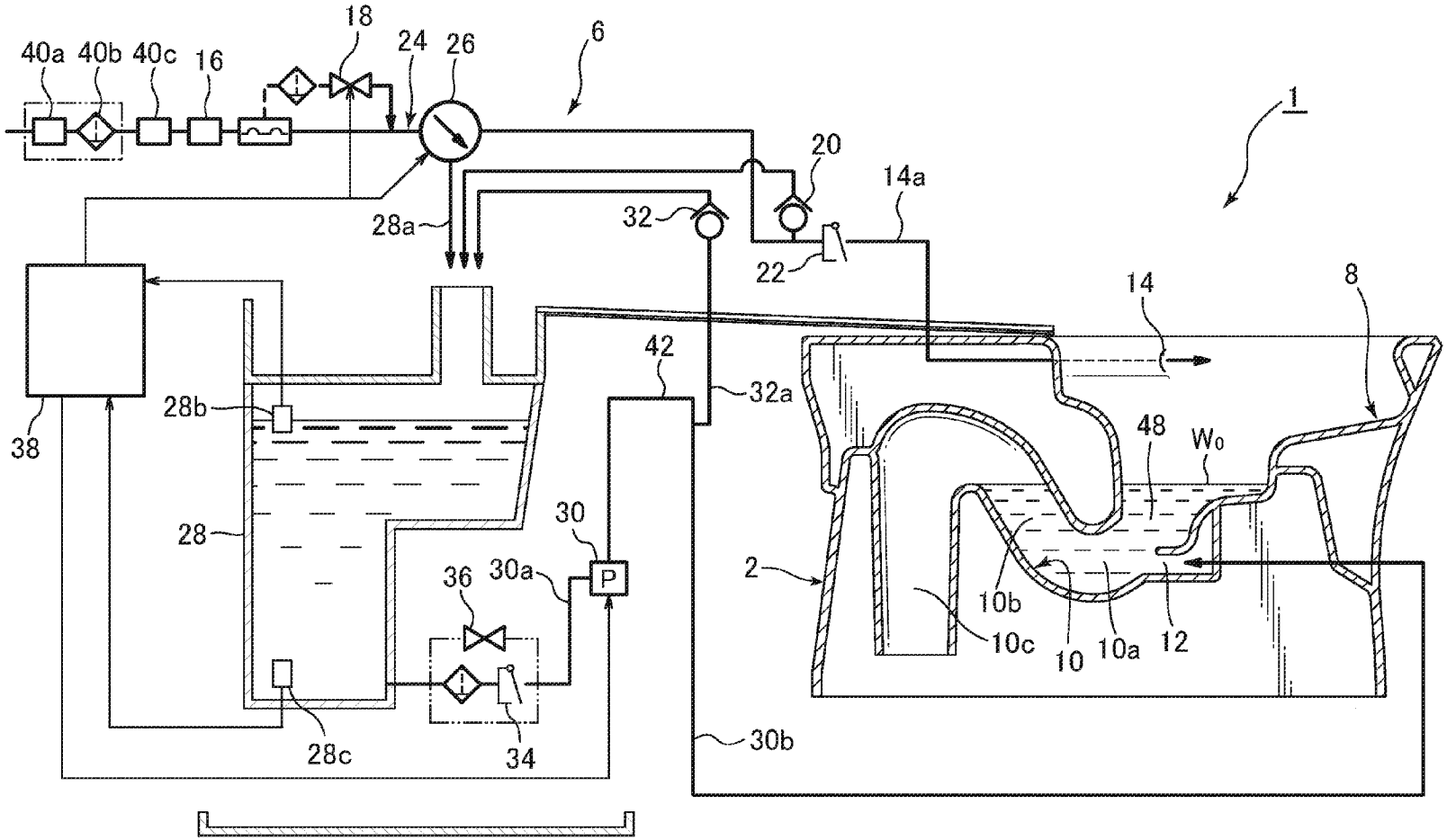
FIG. 3 is an overview schematic showing a flush toilet according to an embodiment of the invention. Here, the toilet lid 4 of the exterior member on the toilet main unit 1 of the flush toiled 1 is omitted in FIG. 3.

Next, using FIG. 3, we explain in detail a flush toilet 1 functional portion 6 according to an embodiment.

FIG. 3 is an overview schematic showing a flush toilet according to an embodiment of the invention. Here, the toilet lid 4 of the exterior member on the toilet main unit 2 of the flush toilet 1 is omitted in FIG. 3.

As shown in FIG. 3, a fixed flow rate valve (fixed flow rate device) 16, electromagnetic valve 18, rim spout vacuum breaker 20 for preventing reverse flow, and rim spout flapper valve 22 for preventing reverse flow are provided. In addition, a switching valve 26 for switching between supplying water to the tank and rim spouting, a water storage tank 28, a pressurizing pump 30, a vacuum breaker 32 for jet spouting, a flapper valve 34 for jet spouting, and a water drain 36 are built into the water supply path 24. There is also a controller 38 built into the functional portion 6 to control the opening/closing operation of the electromagnetic valve 18, the switching operation of the switching valve 26, and the rpm and operating time, etc. of the pressurizing pump 30. By at least a part of this constitution, the functional portion 6 can function as a water supply apparatus for supplying flush water to the toilet main unit 2.

Flush water which has passed through the fixed flow rate valve 16 flows into the electromagnetic valve 18, and flush water which has passed through the electromagnetic valve 18 is supplied to the rim spout port 14 or the water storage tank 28 by the switching valve 26. This switching valve 26 is capable of supplying flush water to both the rim side supply path 14*a* on the rim side and the water storage tank 28 on the tank side at the same timing, and of changing the supply proportions water to the rim side and the tank side.

The electromagnetic valve 18 is opened and closed by a control signal from the controller 38, allowing or stopping supplied flush water from flowing into the switching valve 26.

The switching valve 26 is switched by a control signal from the controller 38, causing flush water flowing in through the electromagnetic valve 18 to be ejected from the rim spout port 14 or to flow into the water storage tank 28.

The water storage tank 28 is constituted to store flush water to be spouted from the jet spout port 12. Note that in the present embodiment the water storage tank 28 has a capacity of approximately 2.5 liters.

A top end float switch 28*b* and a bottom end float switch 28*c* are disposed inside the water storage tank 28 so that the water level inside the water storage tank 28 can be detected. When the water level inside the water storage tank 28 reaches a predetermined stored water level, the top end float switch 28*b* switches on, and the controller 38 senses this and closes the electromagnetic valve 18. On the other hand when the water level inside the water storage tank 28 drops to a predetermined water level, the bottom end float switch 28*c* turns on, and the controller 38 detects this and turns off the pressurizing pump 30.

The pressurizing pump 30 pressurizes flush water stored in the water storage tank 28 and ejects it from the jet spout port 12. The pressurizing pump 30 is connected by a flush water conduit 30*a* extending from the lower portion of the water storage tank 28, and pressurizes flush water stored in the water storage tank 28.

Note that in the present embodiment the pressurizing pump 30 pressurizes flush water in the water storage tank 28 and causes flush water to be spouted from the jet spout port 12 at a maximum flow rate of 120 liters/minute.

A flapper valve 34 for jet spouting and a water drain 36 are disposed midway along the flush water conduit 30*a*.

At the same time, the outflow port on the pressurizing pump 30 is connected to the jet spout port 12 at the bottom portion of the bowl portion 8 through the flush water conduit 30*b*.

The vacuum breaker 32 for jet spouting is connected to the branch conduit 32*a* which branches from the downstream side of the pressurizing pump 30 and the flush water conduit apex portion 42, preventing reverse flow by pooled water in the bowl portion 8 to the water storage tank 28 side and partitioning between those entities.

The controller 38, by manipulation of a toilet flushing switch (not shown), sequentially operates the electromagnetic valve 18, switching valve 26, and pressurizing pump 30, sequentially starting the spouting of water from the rim spout port 14 and jet spout port 12 to flush the bowl portion 8. In addition, after completion of a flush the controller 38 releases the electromagnetic valve 18, switching the switching valve 26 to the water storage tank 28 side and replenishing flush water to the water storage tank 28. When the water level inside the water storage tank 28 rises and the top end float switch 28*b* detects a specified stored water amount, the controller 38 closes the electromagnetic valve 18 and stops the supply of water.

Referring again to FIGS. 1 through 4, we explain each part of the toilet main unit 2.

Figure 4:
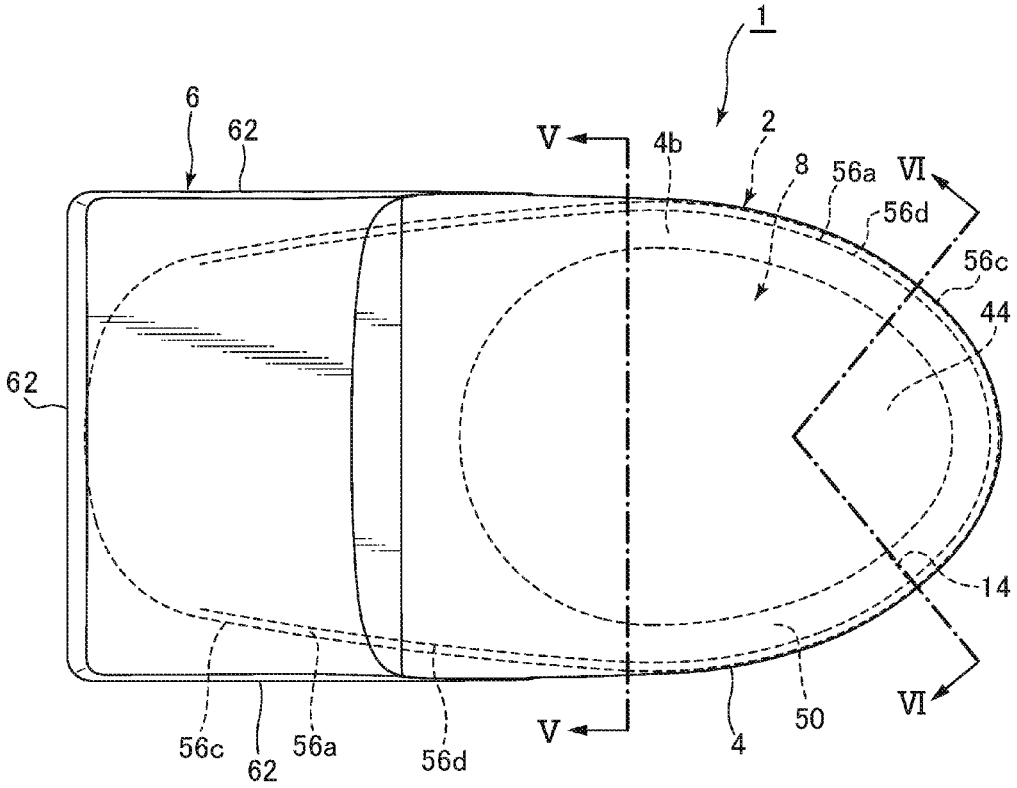
FIG. 4 is a summary plan view showing a functional portion and a toilet lid attached to a toilet main unit in a flush toilet according to an embodiment of the invention.

FIG. 4 is a summary plan view showing a functional portion and a toilet lid attached to a toilet main unit in a flush toilet according to an embodiment of the invention.

The bowl portion 8 comprises a waste receiving surface 44 formed in a bowl shape, and a rim portion 46, formed on the outside at the top of the entire perimeter of the bowl portion 8 and forming the upper edge of the toilet main unit 2. Also, a pooled water portion 48 is formed at the bottom of the bowl portion 8. In the pooled water portion 48, flush water is accumulated up to a predetermined amount after each flushing, and a pooled water surface W0 is formed. The above-described discharge trap conduit 10 inlet portion 10*a* is opened at the bottom of this pooled water portion 48, and the bottom end of the discharge trap conduit 10 trap descending pipe 10*c* is connected to a discharge pipe (not shown) under the floor though a discharge socket (not shown).

The sheet portion 50 extends forward from the inlet portion (not shown) connected to the rim side supply path 14*a* which extends from the functional portion 6, and communicates with the rim spout port 14, which opens forward on the left side of the front region of the bowl portion 8 on the front side relative to the left-right extending center line, which equally divides the bowl portion 8 in the front to back direction. The rim spout port 14 spouts flush water forward from the front region of the bowl portion 8, forming a flow toward the front end of the bowl portion 8, and also forming a flow which reverses from the front end 8*a* of the bowl portion 8 toward the rear side.

Flush water spouted from the rim spout port 14 is spouted from the rim spout port 14 in the front to back direction of the toilet onto the surface between the rim portion 46 and the rim portion 46 vertical wall 52*b* forming a circulating current; a falling current is formed in which this circulating current flows downward as it circulates from the rim portion 46 vertical wall 52*b* over the waste receiving surface 44 in the direction of the pooled water portion 48.

Next, using FIGS. 5-8, we discuss in detail the above-described rim portion 46.

Figure 5:
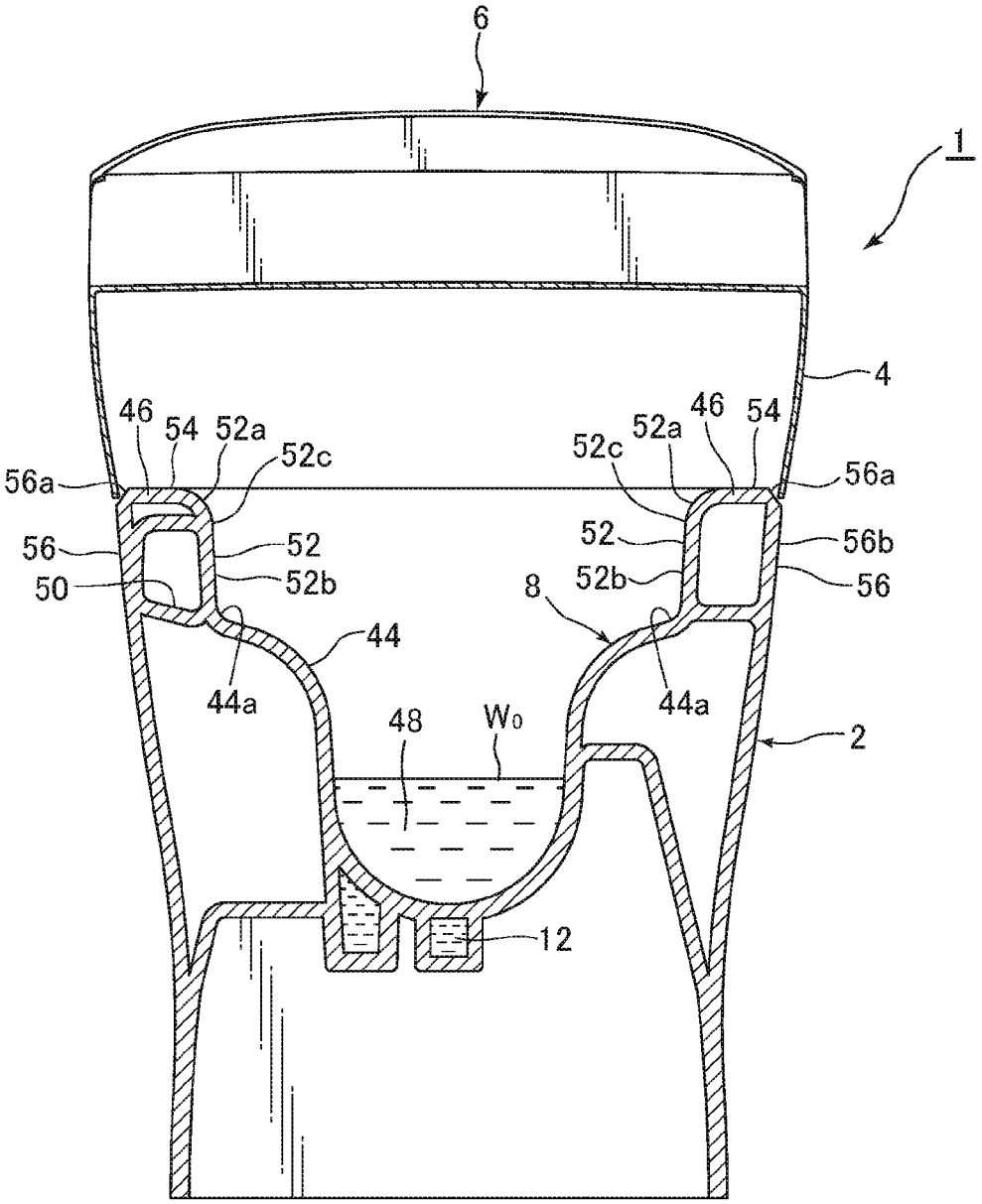
FIG. 5 is a cross section seen along line V-V in FIG. 4.
Figure 6:
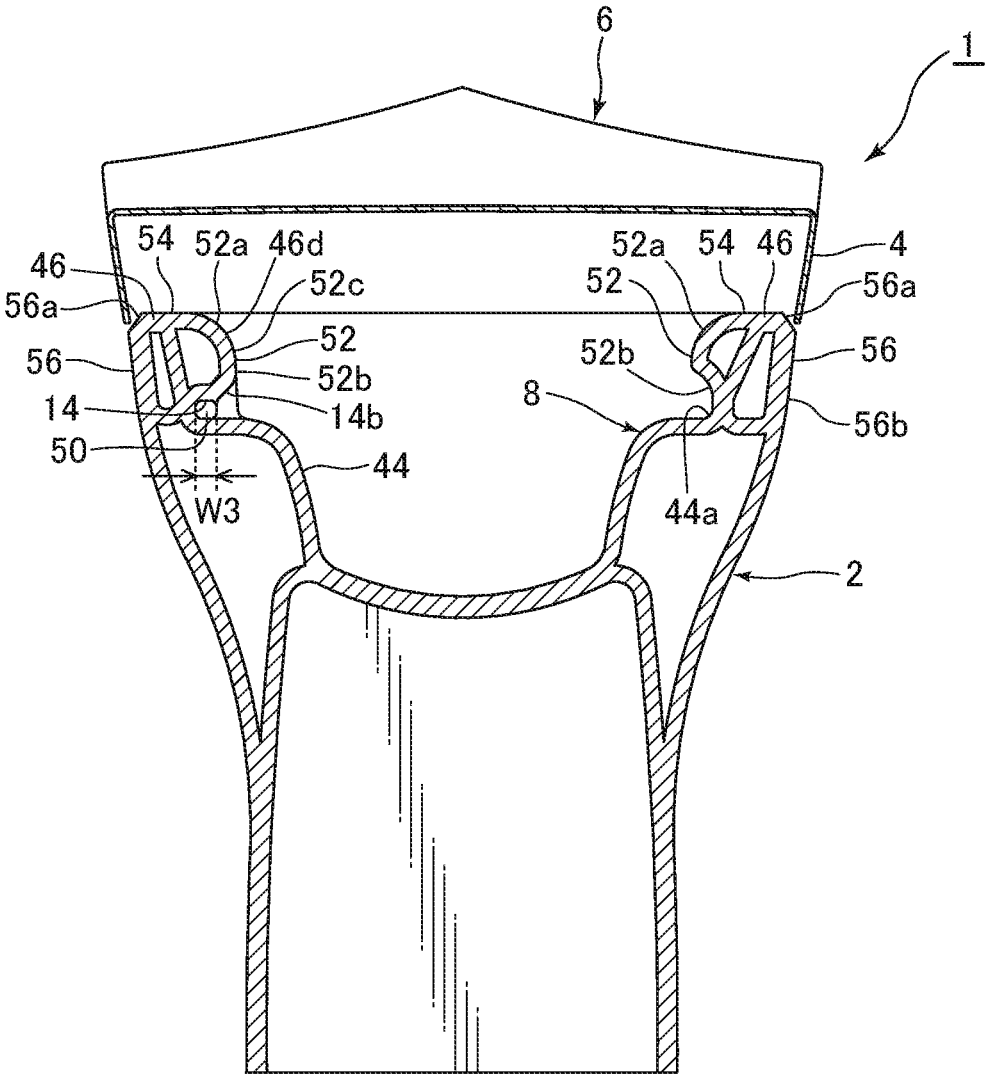
FIG. 6 is a cross section seen along line VI-VI in FIG. 4.
Figure 7:
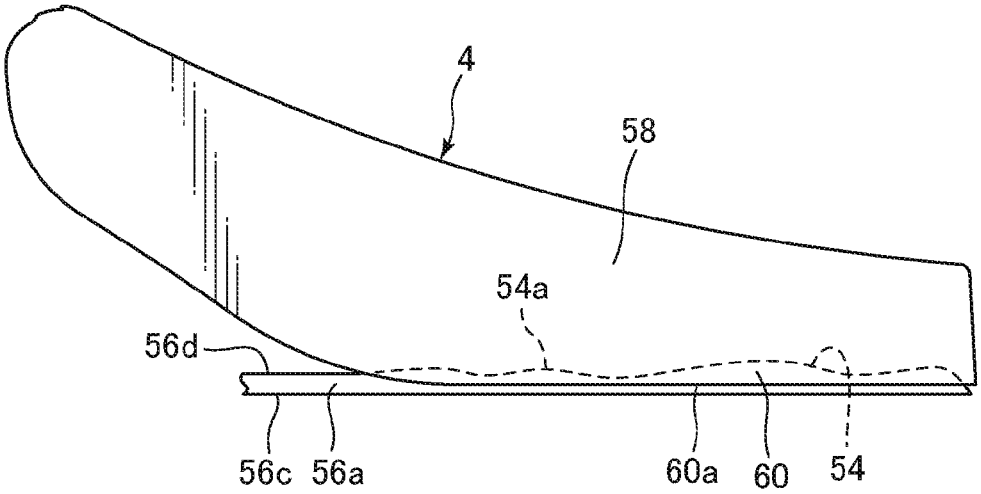
FIG. 7 is a summary expanded cross section seen from the side of a toilet main unit showing the positional relationship between a toilet lid bottom end portion and the rim outer wall upper sloped surface of the toilet main unit rim portion, with the toilet lid closed in a flush toilet according to an embodiment of the invention.
Figure 8:
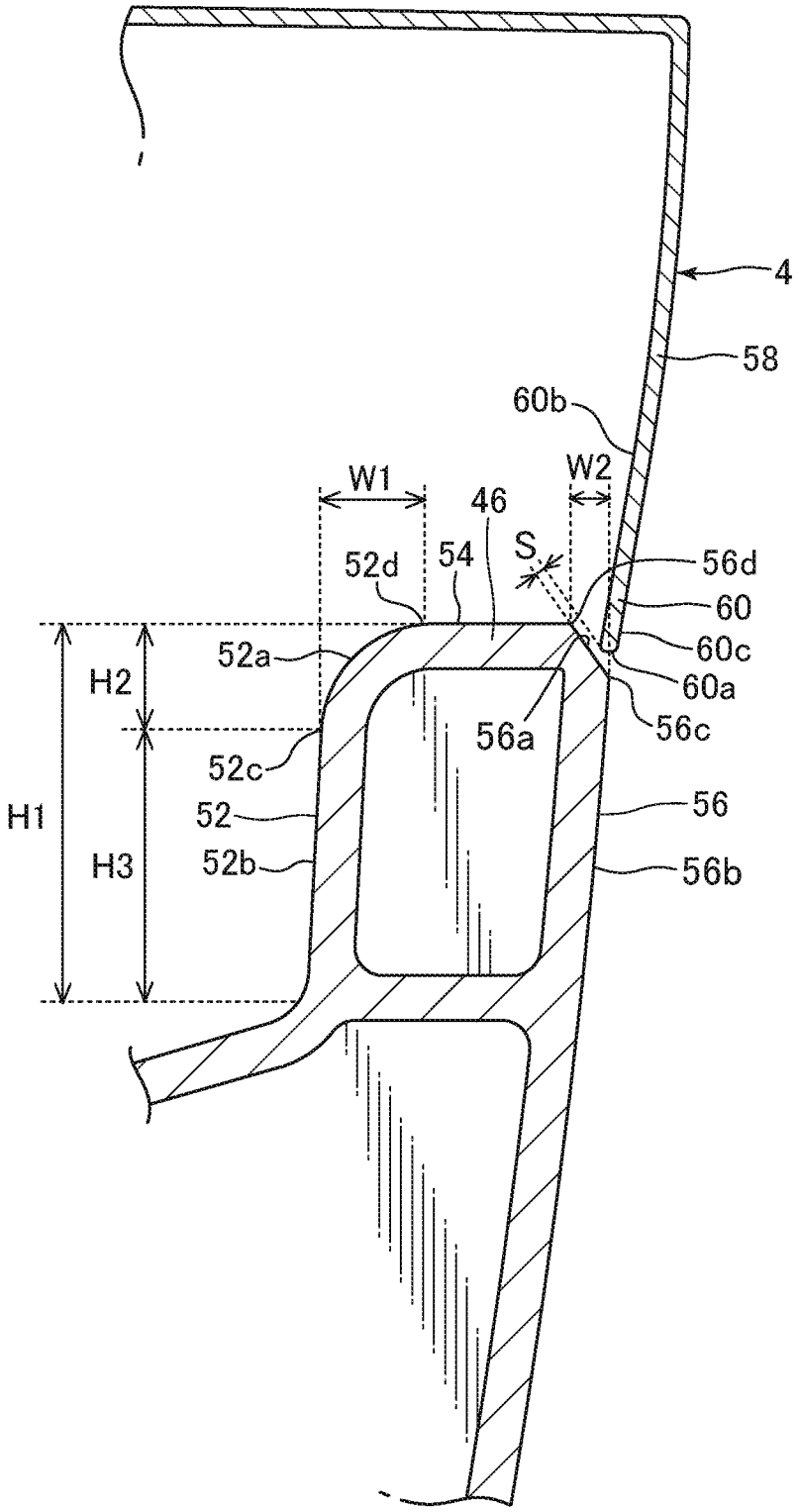
FIG. 8 is a summary expanded cross section showing the positional relationship between a toilet lid bottom end portion and the rim outer wall upper sloped surface of the toilet main unit rim portion relative to the rim portion vicinity in FIG. 5.

FIG. 5 is a cross section seen along line V-V in FIG. 4; FIG. 6 is a cross section seen along line VI-VI in FIG. 4; FIG. 7 is a summary expanded cross section seen from the side of a toilet main unit showing the positional relationship between a toilet lid bottom end portion and the rim outer wall upper sloped surface of the toilet main unit rim portion, with the toilet lid closed in a flush toilet according to an embodiment of the invention; FIG. 8 is a summary expanded cross section showing the positional relationship between a toilet lid bottom end portion and the rim outer wall upper sloped surface of the toilet main unit rim portion relative to the rim portion vicinity in FIG. 5.

The rim portion 46 comprises: a rim inner wall portion 52 forming the inner perimeter surface of the rim portion 46 and formed in a standing wall shape rising from the top end 44*a* of the waste receiving surface 44 up to the apex portion of the toilet main unit 2, a rim top surface portion 54 forming the top surface of this rim portion 46, and a rim outer wall portion 56 forming the outer perimeter surface of the rim portion 46 and formed in a standing wall shape rising up the outside surface of the toilet main unit 2 up to the rim top surface portion 54.

The rim inner wall portion 52 comprises a rim inner wall upper sloped surface 52*a* wherein the inside of the upper region of the rim inner wall portion 52 (the waste receiving surface 44 side) slopes downward, and a vertical wall 52*b* forming a wall surface in the vertical direction up to the rim inner wall upper sloped surface 52*a*.

The rim inner wall portion 52 is formed over the entire perimeter on the inside of the rim portion 46. The vertical wall 52*b* is formed so that in most of the region it rises essentially vertically, but of the rim inner wall portion 52, in a part of the region from the rim spout port 14 of the bowl portion 8 forward, the top portion of the vertical wall 52*b* and the rim inner wall upper sloped surface 52*a* are formed in an overhanging shape toward the inside of the bowl portion 8.

The vertical wall 52*b* forms a wall surface which rises in the vertical direction from the waste receiving surface 44 top end 44*a* to the rim inner wall upper sloped surface 52*a* bottom end 52*c*. For example, the vertical wall 52*b* may also be a vertical wall rising vertically from the top end of the waste receiving surface 44.

Here the height of the rim inner wall portion 52 is formed in a relatively limited range of heights, from the top end 44*a* of the waste receiving surface 44 positioned relative to the height of the drain pipe, to the apex portion of the toilet main unit 2 positioned relative to the height of the toilet main unit 2. Therefore in the rim inner wall portion 52, it is the rim inner wall upper sloped surface 52*a* which is of itself formed on the top portion thereof, such that in the remaining part the height of the vertical wall 52*b* forming the vertical wall up to the rim inner wall upper sloped surface 52*a* is formed to be relatively low.

The rim inner wall upper sloped surface 52*a* of the rim inner wall portion 52, viewed in vertical cross section, is formed over a region at a height H2 in a range of 10% to 60% of the height H1 of a predetermined region from the top end to the bottom end of the rim inner wall portion 52.

The rim inner wall portion 52 vertical wall 52*b*, viewed in vertical cross section, is formed over a region at a height H3 in a range of 40% to 90% of the height H1 of a predetermined region from the top end to the bottom end of the rim inner wall portion 52.

The rim inner wall upper sloped surface 52*a* forms a sloped portion smoothly connecting the corner portion between the horizontally oriented rim top surface portion 54 and the vertically oriented vertical wall 52*b*. The rim inner wall upper sloped surface 52*a* forms an arc shape projecting toward the center top of the bowl portion 8. In other words, it forms an arc shape which connects the rim top surface portion 54 and the inside perimeter wall surface 52*b*.

The rim inner wall upper sloped surface 52*a* is formed so that its outside top end 52*d* is positioned at the height of the rim top surface portion 54, and the inside of the rim inner wall upper sloped surface 52*a* slopes downward; and the top of the rim inner wall upper sloped surface 52*a* is formed to widen toward the outside more than the bottom end 52*c*. Note that rim inner wall upper sloped surface 52*a* may also be formed into a curved surface shape so as impart rounding to the entirety while including a relatively flat surface in a part of the surface between the rim top surface portion 54 and the vertical wall 52*b*.

The sloped portion smoothly connecting the horizontally oriented rim top surface portion 54 and the vertically oriented vertical wall 52*b* of the rim inner wall upper sloped surface 52*a* may also be formed by a beveled surface. I.e., the surface between the rim top surface portion 54 and the vertical wall 52*b* may be formed by a flat surface of a predetermined angle. For example, in the vertical cross section of rim portion 46, the beveled surface may preferably form a flat surface within an angular range of 20° to 70° relative to the plumb line passing through the rim inner wall upper sloped surface 52*a* bottom end 52*c*, and more preferably may form a flat surface within an angular range of 35° to 55°. The beveled surface may also form a flat surface with a 45° angle relative to the plumb line passing through the bottom end 52*c* thereof.

The rim inner wall upper sloped surface 52*a* is formed in an arc shape so that the slope of the tangent on the surface thereof changes continuously according to position. Therefore when a user places his hand to fit the rim inner wall upper sloped surface 52*a*, the occurrence of a space between his hand and the rim inner wall upper sloped surface 52*a* can be constrained, and the hand can be naturally placed to follow the entire curved surface. Note that the rim inner wall upper sloped surface 52*a* may also be formed by a curved surface of another shape to match the curve in the human hand.

Note that the case of the above-described user placing his own hand so as to fit the rim inner wall upper sloped surface 52*a* includes not only the case of fitting the entire hand, but also the palm and the fingers alone. In addition, fitting of a user's hand to the rim inner wall upper sloped surface 52*a* includes cases of fitting the hand to the rim inner wall upper sloped surface 52*a* mediated by a cleaning cloth or paper such as toilet paper for cleaning the toilet, etc. Also, fitting of a user's hand to the rim inner wall upper sloped surface 52*a* includes cases in which the user fits his hand to the rim inner wall upper sloped surface 52*a* mediated by a cleaning cloth or the like with gloves or the like on the user's hand.

Seen in top view, a waste receiving surface 44 forming a curved surface descending as it curves at the center is disposed at the center in the left-right direction of the toilet main unit 2 (the cross sectional direction when the toilet main unit 2 is viewed from the front); and a rim inner wall upper sloped surface 52*a* forming a curved surface, the inside of which similarly drops downward, is disposed on the outside of the waste receiving surface 44. Therefore when seen from the top plan view, a rim inner wall upper sloped surface 52*a* with a gradually inward descending curved surface connects to the outside perimeter of the waste receiving surface 44, and can thereby convey to a user the impression of forming a continuous outwardly spreading curved surface. I.e., a user can receive the impression that the waste receiving surface 44 is still further widened outward by the region of the rim inner wall upper sloped surface 52*a*. For example, in a case in which a male user urinates standing in front of the toilet main unit 2, the worry that urine will miss the waste receiving surface 44 is constrained by conveying to the user the impression that the waste receiving surface 44 is wide, thereby enabling the user to urinate with ease. Moreover, even in cases where a user urinates in a sitting position on the toilet main unit 2 seat (not shown), conveying to the user the impression that the waste receiving surface 44 is wide before the toilet seat (not shown) is lowered constrains the worry that urine will miss the waste receiving surface 44, so that an impression of ease in urination can be conveyed.

As shown in FIG. 6, the bottom end 52*c* of the rim inner wall upper sloped surface 52*a* is placed above the rim spout port 14 apex portion 14*b*. More particularly, the bottom end 52*c* of the rim inner wall upper sloped surface 52*a* is placed above the rim spout port 14 apex portion 14*b*. Put another way, the vertical wall 52*b* is formed up to a height above the apex portion 14*b* of the rim spout port 14. Therefore the rim spout port 14 spouts flush water so that it contacts the vertical wall 52*b* on the proximate downstream side.

A rim inner wall upper sloped surface 52*a* of the type described above is formed in a relatively gentle arc shape, with a relatively wide width in the left-right direction. The width W1 in the horizontal direction (e.g., the direction from the inside toward the outside of the toilet main unit) between the top end 52*d* and the bottom end 52*c* of the rim inner wall upper sloped surface 52*a* is formed to be larger than the left-right width W3 of the rim spout port 14 opening. The bottom end 52*c* of the rim inner wall upper sloped surface 52*a* is placed above the rim spout port 14, therefore the horizontal width W1 of the rim inner wall upper sloped surface 52*a* can be formed to be relatively large, and the vertical height H1 of the rim inner wall upper sloped surface 52*a* can also be formed to be relatively large. Hence the rim inner wall upper sloped surface 52*a* can be formed to slope downward on the inside along a gradual arc shape with a large diameter.

The rim top surface portion 54 forms a lateral surface extending in the horizontal direction, and also forms the apex surface of the toilet main unit 2. For a user to clean the rim portion 46 of the toilet main unit 2 requires cleaning the rim inner wall upper sloped surface 52*a* and vertical wall 52*b* with the user's palm or the like disposed on the rim top surface portion 54 to follow it horizontally, and with fingers bent. Note that the rim top surface portion 54 is not limited to a horizontal surface, and may also be formed as a downward sloping surface or an upward sloping surface toward the bowl portion 8.

Also, the rim top surface portion 54 may be formed by a curved surface. In addition, the rim top surface portion 54 may also be formed as part of a curving surface in which the outer end of the rim inner wall upper sloped surface 52*a* is extended to the outside, or may be formed as part of a curving surface in which the inner end of the rim outer wall upper sloped surface 56*a* is extended to the inside. For example, if the rim top surface portion 54 is formed as a part of the rim inner wall upper sloped surface 52*a*, the outer end of the rim inner wall upper sloped surface 52*a* and the inner end of the rim outer wall upper sloped surface 56*a* can be relatively smoothly connected, and the rim portion 46 top surface formed.

The rim outer wall portion 56 comprises a rim outer wall upper sloped surface 56*a* which connects a horizontally oriented rim top surface portion 54 and a vertically oriented rim outer wall and forms the outside edge (the outside of toilet main unit 2) on the top portion of the rim portion 46, and a rim outer wall 56*b* which forms a wall in the vertical direction up to the rim outer wall upper sloped surface 56*a*.

In the rim outer wall upper sloped surface 56*a*, the top end 56*d* thereof is positioned at the height of the rim top surface portion 54 between the rim top surface portion 54 and the rim outer wall 56*b*, and the outer side thereof forms a sloped surface sloping downward.

In the present embodiment the rim outer wall upper sloped surface 56*a* is formed as a 45° sloped surface (beveled surface) having a 45° slope angle relative to plumb (or 45° relative to the planar direction of the rim top surface portion 54). The rim outer wall upper sloped surface 56*a* may be formed as a sloped surface (beveled surface) with another slope angle relative to the plumb direction; e.g., it is preferably formed as a sloped surface with a slope angle (beveled surface) in a range of 20° to 70°.

Moreover, the rim outer wall upper sloped surface 56*a* may also form a curved surface with a gentle curve between the rim top surface portion 54 and the rim outer wall 56*b*.

For example, seen in vertical cross section, the rim outer wall upper sloped surface 56*a* may also be formed by an arc with a radius r of 5 mm to 8 mm. Note that the rim inner wall upper sloped surface 52*a* when seen in vertical cross section is formed by an arc having a radius R of 10 mm to 30 mm and more preferably 16 mm to 25 mm. When the rim outer wall upper sloped surface 56*a* is formed by an arc, the ratio of the radius r of the arc forming the rim outer wall upper sloped surface 56*a* to the radius R of the arc forming the rim inner wall upper sloped surface 52*a* is formed in a range of 1:2 to 1:5.

In the present embodiment the rim inner wall upper sloped surface 52*a* horizontal width W1 (e.g., the direction from inside toward the of the toilet main unit) is formed to be wider than the horizontal width W2 (e.g., the direction from inside toward the of the toilet main unit) between the top end 56*d* and the bottom end 56*c* of the rim outer wall upper sloped surface 56*a*. The rim inner wall upper sloped surface 52*a* and rim outer wall upper sloped surface 56*a* are formed by a sloped surface, therefore when a user places his hand on the rim inner wall upper sloped surface 52*a* and the rim outer wall upper sloped surface 56*a*, the hand can be disposed naturally along the rim inner wall upper sloped surface 52*a* and the rim outer wall upper sloped surface 56*a*, and an easily gripped shape is formed, without producing a relatively large space between the hand and the rim portion 46.

Also, as described above, in at least a portion of the entire perimeter of the rim portion 46, the vertical wall 52*b* and rim inner wall upper sloped surface 52*a* are formed in an overhanging shape toward the inside, so the rim portion 46 is made easier to grip such that an installer, manufacturer, or the like can lift it up with hands placed on the inside of the rim portion 46 overhang shape. Therefore when an installer or manufacturer carries the toilet, placement of hands on the rim portion 46 formed in an overhanging shape enables the load being lifted upward to act more easily on the rim portion 46, with fingertips locked into the underside of the rim inner wall upper sloped surface 52*a*, facilitating carrying of the toilet.

Next, referring to FIGS. 5 to 8, we explain the relationship between the above-described rim portion 46 rim outer wall upper sloped surface 56*a* and the toilet lid 4.

As shown in FIGS. 5 through 8, the toilet lid bottom end portion 60 of the side wall 58 on the toilet lid 4 is disposed at the height of the rim outer wall upper sloped surface 56*a*. The side walls 58 on toilet lid 4 include vertical walls on the left and right sides and on the front side when viewed from the front side of the toilet main unit 2. The external part of the exterior member is formed, for example, by the toilet lid 4 side walls 58, by the functional portion 6 side walls and rear walls etc. described below and, in another variant example described below, by the toilet seat side portion, etc.

The toilet lid bottom end portion 60 of the side walls 58 in the toilet lid 4 comprises: a toilet cover bottom end surface 60*a* forming the bottom-most surface of that toilet lid bottom end portion 60, a toilet lid inner surface 60*b* which forms the inner surface of the toilet lid bottom end portion 60, and a toilet lid outer surface 60*c*.

As shown in FIG. 8, in the height direction the toilet lid bottom end portion 60 is positioned between the top end 56*d* and the bottom end 56*c* of the rim outer wall upper sloped surface 56*a*. More particularly, the toilet lid bottom end portion 60 of the toilet lid 4 is disposed at a height below the height of the rim portion 46 rim top surface portion 54, and is disposed at a height above the height of the bottom end 56*c* of the rim outer wall upper sloped surface 56*a*.

Seen in the horizontal direction, the toilet lid inner surface 60*b* of the toilet lid bottom end portion 60 is disposed at a position further inside the toilet than the position of the bottom end 56*c* of the rim outer wall upper sloped surface 56*a*.

Seen in the horizontal direction, the toilet lid outer surface 60*c* of the toilet lid bottom end portion 60 is disposed in the same position as the position of the rim outer wall upper sloped surface 56*a* bottom end 56*c*, or at a position further outside the toilet than the position of the rim outer wall upper sloped surface 56*a* bottom end 56*c*. I.e., the toilet lid bottom end portion 60 toilet lid outer surface 60*c* and the rim outer wall 56*b* are disposed in an essentially flush relationship, or the toilet lid bottom end portion 60 toilet lid outer surface 60*c* is disposed further outside the toilet than the rim outer wall 56*b*.

As shown in FIG. 8, in the height direction the toilet lid bottom end portion 60 of toilet lid 4 is positioned between the top end 56*d* and the bottom end 56*c* of the rim outer wall upper sloped surface 56*a*, therefore when viewed from the toilet side direction, the toilet lid bottom end portion 60 of the toilet lid 4 side walls 58 appears to overlap with the rim outer wall upper sloped surface 56*a*.

Since the toilet main unit 2 is made of ceramic, unevenness 54*a* caused by manufacturing tolerances such as shrinkage tolerances during vitrification when the toilet main unit 2 is manufactured may occur on the rim top surface portion 54. If unevenness 54*a* does occur on the rim top surface portion 54, the toilet lid bottom end portion 60 can extend further down than the unevenness 54*a* so as to hide the unevenness 54*a*. Therefore when seen from the side, the boundary between the toilet lid bottom end portion 60 and the rim outer wall upper sloped surface 56*a* can be shown as the boundary between the toilet lid 4 and the rim outer wall portion 56 as a single line aligned in a straight line manner, without the unevenness 54*a* on the rim top surface portion 54 being visible to the user, so that an aesthetic impression is conveyed to the user.

As shown in FIG. 8, with the toilet lid 4 closed, a gap S is formed between the toilet cover bottom end surface 60*a* and the rim outer wall upper sloped surface 56*a*. For example, a gap S by which the distance between the toilet cover bottom end surface 60*a* and the rim outer wall upper sloped surface 56*a* is minimized is positioned below the top end 56*d* and above the bottom end 56*c*, and is also below the rim top surface portion 54. Thus the toilet cover bottom end surface 60*a* and the rim outer wall upper sloped surface 56*a* are arranged not to make direct contact, but when viewed from the lateral direction (the side surface direction), at least a portion of the toilet lid 4 side wall appears to be connected on the rim outer wall upper sloped surface 56*a*; furthermore the boundary between the toilet cover bottom end surface 60*a* and the rim outer wall upper sloped surface 56*a* is perceived as a single aligned straight line with a straight line shape extending in the front to back direction of the toilet cover bottom end surface 60*a*, so an aesthetic impression can be imparted to the user.

Hence even when the position of the toilet cover bottom end surface 60*a* shifts up/down or left/right from the originally intended position due to tolerances in attachment (installation) of the toilet lid 4 to the rim portion 46 or toilet manufacturing tolerances, etc., if the toilet cover bottom end surface 60*a* is positioned between the top end 56*d* and the bottom end 56*c* of the rim outer wall upper sloped surface 56*a*, then when viewed from the toilet lateral direction the toilet cover bottom end surface 60*a* will appear to be overlapping and connected on the rim outer wall upper sloped surface 56*a*; moreover, the boundary between the toilet cover bottom end surface 60*a* and the rim outer wall upper sloped surface 56*a* can be made to appear as a single aligned straight line.

Note that in the present embodiment the functional portion 6 is disposed on the rim top surface portion 54 at the rear of the toilet main unit 2, and the functional portion 6 side wall and rear wall functional portion bottom end portion 62 is disposed on the rim top surface portion 54, but as a variant example it is also acceptable for at least a portion of this functional portion 6 side wall and rear wall functional portion bottom end portion to be extended to a height matching the height of the rim top surface portion 54 or to a height below the rim top surface portion 54, so as to be positioned between the top end 56*d* and the bottom end 56*c* of the rim outer wall upper sloped surface 56*a*.

When the functional portion bottom end portion is thus positioned between the top end 56*d* and bottom end 56*c* of the rim outer wall upper sloped surface 56*a*, the functional portion side wall and the rear wall functional portion bottom end portion will appear to overlap the rim outer wall upper sloped surface 56*a* when seen from the toilet lateral direction. If unevenness 54*a* does occur on the rim top surface portion 54, the functional portion bottom end portion can extend further down than the unevenness 54*a* so as to hide the unevenness 54*a*. Therefore when seen from the side, the boundary between the functional portion bottom end portion and the rim outer wall upper sloped surface 56*a* can be shown as the boundary between the functional portion 6 and the rim outer wall portion 56 as a single line aligned in a straight line manner, without the unevenness 54*a* on the rim top surface portion 54 being visible to the user, so that an aesthetic impression is conveyed to the user.

Note that the flush toilet 1 according to the present embodiment comprises a toilet seat (not shown) disposed on the top surface of the toilet main unit 2, and a toilet lid 4 disposed to cover the toilet seat, but as another variant example the toilet lid 4 may be omitted and a toilet seat disposed on the rim top surface portion 54 on the top surface of the toilet main unit 2 to be applied to a flush toilet functioning as an exterior member determining the outside appearance of the toilet. In such cases, at least a portion of the toilet seat bottom end portion on the side part of the toilet seat (including the front and side parts) may be extended to a height matching the height of the rim top surface portion 54, or to a height below the rim top surface portion 54, so as to be positioned in the height direction between the top end 56*d* and the bottom end 56*c* of the rim outer wall upper sloped surface 56*a*.

When the toilet seat bottom end portion is thus positioned between the top end 56*d* and bottom end 56*c* of the rim outer wall upper sloped surface 56*a*, the toilet seat bottom end portion of the toilet seat side portion will appear to overlap the rim outer wall upper sloped surface 56*a* when seen from the toilet lateral direction. If unevenness 54*a* does occur on the rim top surface portion 54, the toilet seat bottom end portion can extend further down than the unevenness 54*a* so as to hide the unevenness 54*a*. Therefore when seen from the side, the boundary between the toilet seat bottom end portion and the rim outer wall upper sloped surface 56*a* can be shown as the boundary between the functional portion 6 and the rim outer wall portion 56 as a single line aligned in a straight line manner, without the unevenness 54*a* on the rim top surface portion 54 being visible to the user, so that an aesthetic impression is conveyed to the user.

Figure 11:
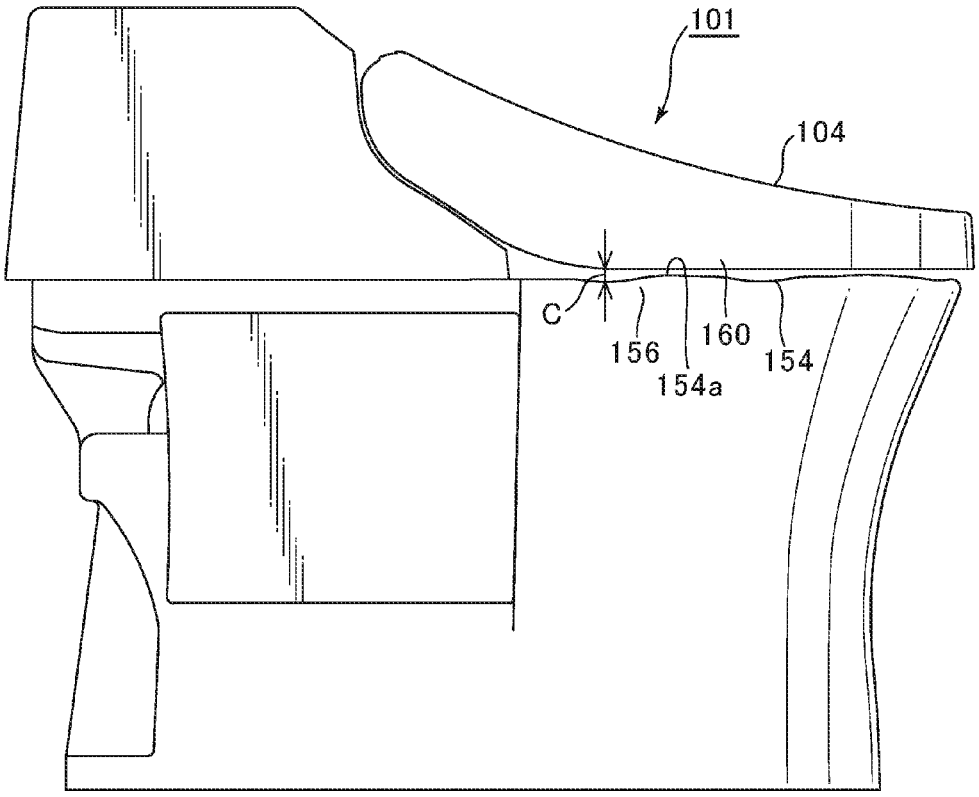
FIG. 11 is a side elevation seen from the side of a toilet main unit, functional portion, and toilet lid in a conventional flush toilet.
Figure 12:
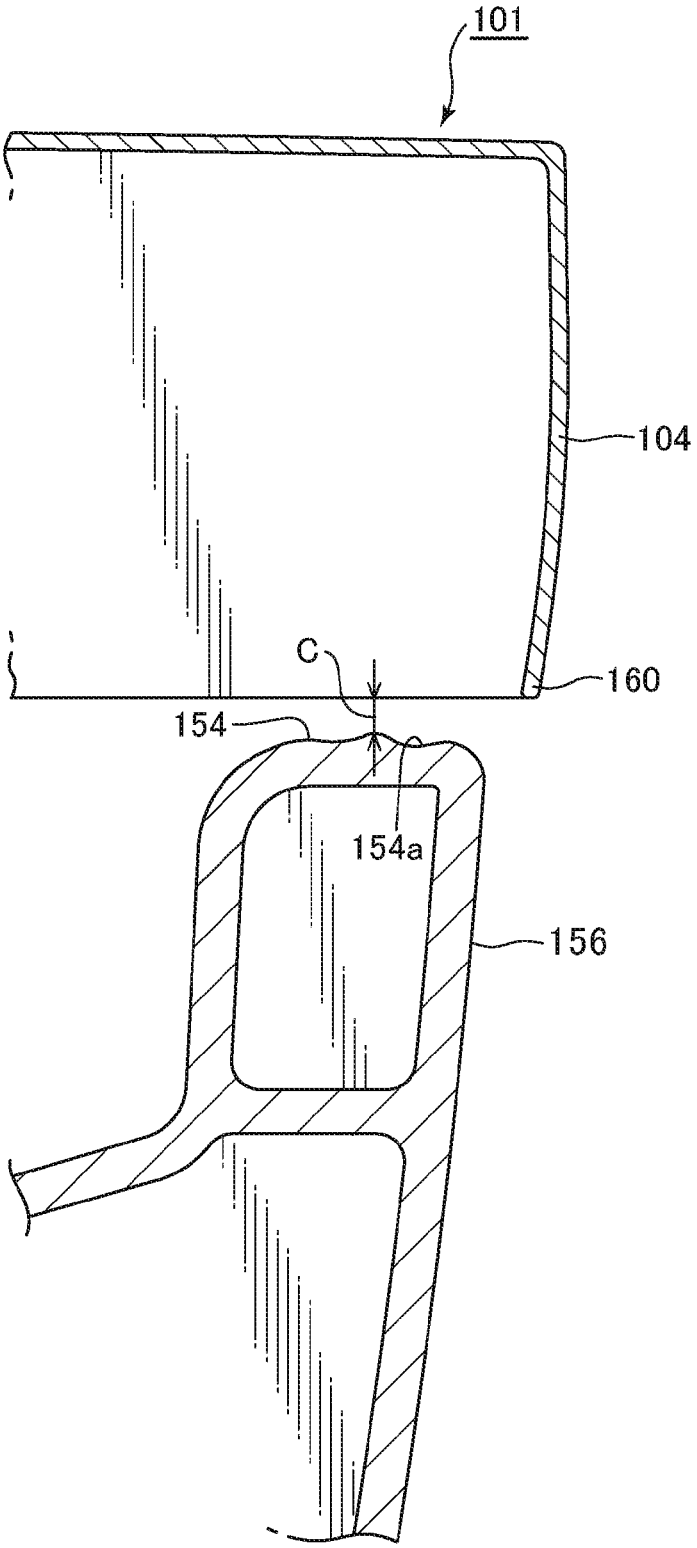
FIG. 12 is a summary expanded cross section showing the positional relationship between a toilet lid bottom end portion and the rim outer wall upper sloped surface of the toilet main unit rim portion relative to the rim portion vicinity of a conventional flush toilet.

Next, referring to FIGS. 11 and 12, we explain differences between a conventional flush toilet 101 and a flush toilet 1 according to the present embodiment.

FIG. 11 is a side elevation seen from the side of a toilet main unit, functional portion, and toilet lid in a conventional flush toilet; FIG. 12 is a summary expanded cross section showing the positional relationship between a toilet lid bottom end portion and the rim outer wall upper sloped surface of the toilet main unit rim portion relative to the rim portion vicinity of a conventional flush toilet.

In the conventional flush toilet 101, a toilet lid toilet lid bottom edge portion 160 is disposed above the rim top surface portion 154 when the toilet lid 104 is closed. In general, in a flush toilet there is a requirement that the toilet lid bottom edge portion 160 and the rim outer wall portion (rim outside edge portion) 156 not make contact, therefore the toilet lid bottom edge portion 160 is disposed outside and above the rim outer wall portion (rim outside edge portion) 156. Therefore a gap C is formed between the toilet lid bottom edge portion 160 and the rim top surface portion 154, and between the toilet lid bottom edge portion 160 and the rim outer wall portion 156. At this point when a user looks from the toilet lateral side direction, a gap C appears to be formed between the toilet lid bottom edge portion 160 and the rim outer wall portion 156, so that in the boundary between the toilet lid 104 and the rim outer wall portion 156, the toilet lid bottom end portion 160 bottom end, the gap C, and the rim outer wall portion 156 top end each appear separately, and the boundary appears as multiple lines, not as a single line. Also, because of the presence of the gap C between the toilet lid bottom edge portion 160 and the rim outer wall portion 156, the toilet interior becomes visible from the gap C, so that an aesthetic impression can no longer be conveyed to the user.

Also, an unevenness 154*a* is visible on the rim top surface portion 154 in the gap C at the boundary of the boundary between the toilet lid bottom edge portion 160 and the rim top surface portion 154, and the boundary between the toilet lid bottom edge portion 160 and the rim top surface portion 154 appears as an uneven line, so the user cannot be shown a single aligned straight line, and an aesthetic impression cannot be imparted to users.

Figure 9:
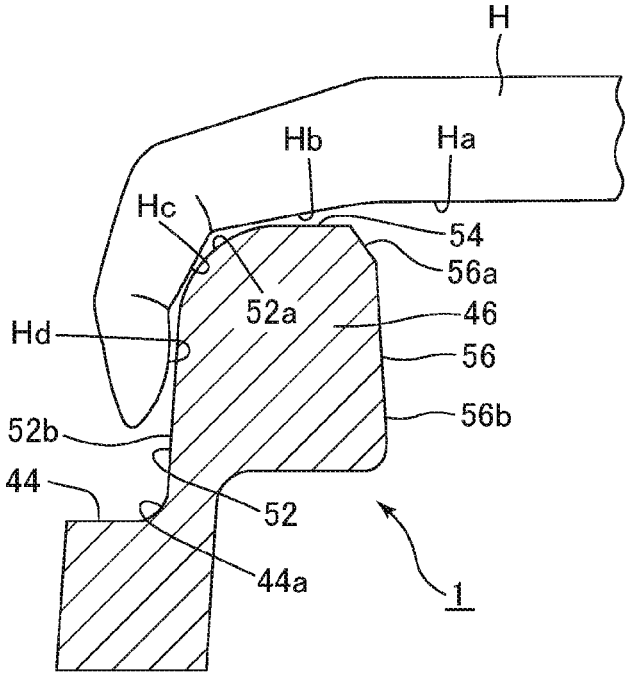
FIG. 9 is a diagram showing the state in which a user's hand is placed to follow along the rim inner wall upper sloped surface of the rim portion in a flush toilet according to an embodiment of the invention.
Figure 10:
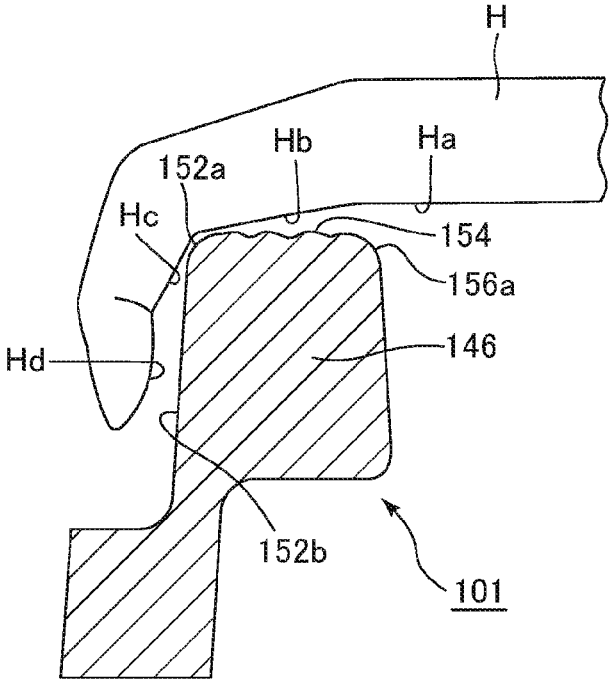
FIG. 10 is a diagram showing the state in which a user's hand is placed on the rim inner wall upper edge portion of a conventional flush toilet.

Next, referring to FIGS. 9 and 10, we explain details of the above-described state, in which a user seeks to clean the rim portion 46.

FIG. 9 is a diagram showing the state in which a user's hand is placed to follow along the rim inner wall upper sloped surface of the rim portion in a flush toilet according to an embodiment of the invention; FIG. 10 is a diagram showing the state in which a user's hand is placed on the rim inner wall upper edge portion of a conventional flush toilet. The user's hand and fingers is denoted in this explanation by an H.

In the present embodiment, when a user seeks to clean the rim portion 46 as shown in FIG. 9, the user cleans with his hand and fingers H positioned so that the palm Ha and/or palm side of the hand Hb contact the rim upper surface portion 54, thereby cleaning the vertical wall 52*b* on the fingertip Hd side. Here the rim top surface portion 54 forms a generally horizontal plane, and the vertical wall 52*b* forms a generally plumb wall surface, therefore a user bends his finger joints to clean the vertical wall 52*b* side. At this point the rim inner wall upper sloped surface 52*a* forms a relatively large radius arc, so the bent part of the fingers (e.g., Hc, Hd) may be bent gradually, and the bent part of the fingers (e.g., Hc) may be positioned to fit the arc in the rim inner wall upper sloped surface 52*a*. Hence a user, for example, can efficiently clean a rim top surface portion 54, a rim inner wall upper sloped surface 52*a*, and a vertical wall 52*b* simultaneously with the palm side part Hb on the finger joint side of the user's hand H in contact with the rim top surface portion 54, and the second finger joint part Hc in contact with the rim inner wall upper sloped surface 52*a*, and with the finger tip part Hd in contact with the vertical wall 52*b*. Moreover, since a user can place his hand and fingers H in contact with the rim top surface portion 54, the rim inner wall upper sloped surface 52*a*, and the vertical wall 52*b* without bending the hand and fingers forcedly, a user can easily impart the force needed for cleaning to the hand and fingers H. Therefore the cleanability of the rim top surface portion 54, the rim inner wall upper sloped surface 52*a*, and the vertical wall 52*b* is also improved.

When a user cleans the rim inner wall upper sloped surface 52*a* and the vertical wall 52*b* from the rim top surface portion 54 side, cases in which sufficient cleaning force cannot be applied to the rim inner wall upper sloped surface 52*a*, leading to problems in cleaning the rim inner wall upper sloped surface 52*a* which result in problems with the cleaning of the rim inner wall upper sloped surface 52*a* and necessitate further cleaning work, can be constrained.

For this purpose, in a conventional flush toilet 101, as shown in FIG. 10, a conventional rim inner wall upper edge portion 152*a* is formed in the rim portion 146. In a conventional flush toilet 101, when a user seeks to clean a rim portion 146, and the user cleans with the palm Ha of the hand (hand and fingers) H and/or the palm side part Hb of the fingers positioned to contact the rim top surface portion 154, the rim inner wall upper edge portion 152*a* forms a connecting part (edge portion) consisting of a relatively small radius arc (an arc with essentially the same radius as the rim outer wall upper sloped surface 156*a*), so that bent finger parts such as the second finger joint part Hc cannot be positioned to fit the arc of the rim inner wall upper edge portion 152*a*. I.e., the second finger joint part Hc on the user's hand H becomes separated from the rim inner wall upper edge portion 152*a*, and the fingertip part Hd is separated from the vertical wall 152*b*.

In order to move from this state to one in which the fingertip part Hd contacts the vertical wall 152*b* requires that the palm Ha and the palm-side portion of fingers Hb be slightly lifted to separate from the rim top surface portion 154.

In the conventional flush toilet 101, the limited movable range of the human finger joints means that even if the hand is excessively bent so that the finger joint side portion of fingers Hb of the user's hand H is in contact with the rim top surface portion 154, and the second finger joint part Hc is in contact with a part of the top portion of the rim inner wall upper edge portion 152*a*, not only will contact not be possible between the second finger joint part Hc and the conventional rim inner wall upper edge portion 152*a* lower portion, but the fingertip part Hd and the vertical wall 152*b* also cannot be placed in a contacting state. Therefore problems arise with cleaning the rim inner wall upper edge portion 152*a* and the vertical wall 152*b*, and even more cleaning work results.

In the conventional flush toilet 101, the limited movable range of the human finger joints means that even if the hand is excessively bent so that the finger joint side portion of fingers Hb of the user's hand H is in contact with the rim top surface portion 154, and the fingertip part Hd is in contact with the vertical wall 152*b*, it is not possible to simultaneously place the second finger joint part Hc and the rim inner wall upper edge portion 152*a* in a contacting state. Therefore problems arise with cleaning the rim inner wall upper edge portion 152*a*, and even more cleaning work results.

Moreover, the rim top surface portion 154 and a part of another curved surface cannot be simultaneously placed in a contacting state unless the user's hand H is excessively bent, so it is difficult for the user to apply the force to hand H required for cleaning. Therefore problems arise with the cleanability of the rim top surface portion 154, the conventional rim inner wall upper edge portion 152*a*, and the vertical wall 152*b*.

We again explain a flush toilet 1 according to an embodiment of the invention.

In a flush toilet 1 according to the above-described embodiment of the invention, the rim inner wall portion 52 comprises a rim inner wall upper sloped surface 52*a* in which the inside of the upper region of the rim inner wall portion 52 slopes downward.

Therefore when a user wipes clean a rim portion 46, he can efficiently clean the rim portion 46 rim top surface portion 54, rim inner wall upper sloped surface 52*a*, and vertical wall 52*b* with his own hand placed from the rim portion 46 top surface to the vertical wall 52*b* so as to follow the rounding of the rim inner wall upper sloped surface 52*a*. In addition, because cleaning can be performed while applying a relatively uniform force from the rim portion 46 top surface portion 54 to the rim inner wall upper sloped surface 52*a* and vertical wall 52*b*, the user can easily impart a relatively strong force to the entirety of the rim portion to be wiped clean, so that cleaning performance can be improved.

The rim inner wall portion 52 comprises a rim inner wall upper sloped surface 52*a*, wherein the inside of the upper region of a rim inner wall portion 52 slopes downward. Therefore the rim inner wall upper sloped surface 52*a* formed on the upper and outer side of the waste receiving surface 44 can give the user the impression that the waste receiving surface 44 widens further outward, and the bowl portion 8 can be made to appear relatively larger than in the past, thereby imparting a feeling of ease so that the user can discharge urine more easily into the bowl portion 8 during use.

Also, in the flush toilet 1 according to the above-described embodiment of the invention, the rim portion 46 comprises a rim outer wall upper sloped surface 56*a* being positioned in an outside of an upper region of the rim outer wall 56 and being sloped downward toward an outer of the bowl portion, therefore at least a portion of the exterior part of the toilet lid 4 positioned on the rim portion 46 can be easily assembled and positioned at the height of the rim outer wall upper sloped surface 56*a*; furthermore, viewed from the toilet lateral direction, the boundary between the exterior part of at least a part of the toilet lid 4 and the rim outer wall upper sloped surface 56*a* appears as a single straight, aligned line, so that an aesthetic impression can be imparted to the user.

Also, using the flush toilet 1 according to the above-described first embodiment of the invention, a horizontal distance W1 between an top end of the rim inner wall upper sloped surface and a bottom end of the rim inner wall upper sloped surface 52*a* is formed to be longer than a horizontal distance W2 between an top end of the rim outer wall upper sloped surface and a bottom end of the rim outer wall upper sloped surface 56*a*, therefore when a user wipes clean the rim portion 46, he can clean the rim portion 46 rim top surface portion 54, the rim inner wall upper sloped surface 52*a*, and the rim inner wall portion 52 efficiently with his own hand placed from the top portion of the rim portion 46 up to the inner wall of the rim portion 46 so as to follow the sloping surface of the rim inner wall upper sloped surface 52*a*. In addition, because cleaning can be performed while applying a relatively uniform force from the rim portion 46 top surface to the rim inner wall upper sloped surface 52*a* and rim inner wall portion 52, the user can easily impart a relatively strong force to the entirety of the rim portion 46 to be wiped clean, so that cleaning performance can be improved.

Also, using a flush toilet 1 according to the above-described embodiment of the invention, flush water spouted from the rim spout port 14 is circulated along a region below the bottom end 52*c* of the rim inner wall upper sloped surface 52*a*, therefore flush water can be constrained from exceeding the rim inner wall upper sloped surface 52*a* and splashing outside the toilet. Because flush water is circulated in this manner along a region below the bottom end 52*c* of the rim inner wall upper sloped surface 52*a*, the width and size, etc. of the rim inner wall upper sloped surface 52*a* can be formed to be relatively large. However, the present invention is not limited to such embodiments; for example, a similar effect can be obtained if the position of the bottom end 52*c* of the rim inner wall upper sloped surface 52*a* at the maximum height reached by flush water in the rim spout port 14 is high. For example, an arrangement is acceptable whereby if the height of flush water spouted from the rim spout port 14 reaches only the center of the rim spout port 14, the bottom end 52*c* of the rim inner wall upper sloped surface 52*a* will be at a higher position than the center of the rim spout port 14.

Also, using a flush toilet 1 according to the above-described embodiment of the invention, the radius of the arc forming the rim inner wall upper sloped surface 52*a* is formed to be a radius easily gripped by the curve in a user's hands. It is therefore easy for the user's own hand to follow the arc shape forming the rim inner wall upper sloped surface 52*a* when a user is wiping clean the rim portion 46.

In the flush toilet 1 according to the above-described embodiment of the invention, installers, manufacturers, and the like can, when transporting the toilet, carry the toilet in a favorable manner by placing hands on the rim portion 46 formed with overhangs, with hands gripping.

Also, in the flush toilet 1 according to the above-described embodiment of the invention, the rim spout port 14 can form a circulating current flowing from the bowl portion 8 front end 8*a* toward the rear, and the bowl portion can be sufficiently flushed while conserving water.

Also, in the flush toilet 1 according to the above-described embodiment of the invention, in the region from the bowl portion 8 rim spout port 14 to the front side thereof, where flush water spouted from the rim spout port 14 can easily pass over the rim portion 46 and splash outside the toilet, the rim portion 46 has an upper portion that overhangs inwardly being disposed on the front side of an outlet of the rim spout port 14, therefore splashing of flush water outside the toilet can be constrained.

In the flush toilet 1 according to the above-described first embodiment of the invention, the surge of flush water supplied by a flush water supply apparatus (functional portion 6) using water utility supply pressure from a flush water source during spouting is relatively constrained. It is therefore more difficult for flush water spouted from the rim spout port 14 to pass from the bowl portion 8 over the rim portion 46 and splash, and the width of the rim inner wall upper sloped surface 52*a* can be made wide.

Also, in the flush toilet 1 according to the above-described embodiment of the invention, the rim portion 46 comprises a rim outer wall upper sloped surface 56*a* wherein the outside of the upper region of the rim outer wall 56*b* slopes downward, and the bottom end of at least a portion of the exterior part of the toilet lid 4 is disposed at a height below the height of the rim portion 46 rim to surface portion 54, so that at least a portion of the exterior part of the toilet lid 4 can be disposed at the height of the rim outer wall upper sloped surface 56*a*.

What is claimed is:

1. A flush toilet comprising:

a bowl portion including a bowl-shaped waste receiving surface and a rim portion formed on a top edge of the waste receiving surface;

a water discharge path for discharging waste, the water discharge path having an inlet that is connected at a bottom of the bowl portion;

a water spouting portion for spouting flush water to the bowl portion to generate a circulating current;

a water conduit for supplying flush water to the water spouting portion; and an exterior member including an exterior part disposed over the rim portion;

wherein the rim portion comprises a rim outer wall portion forming an outer perimeter of the rim portion, and a rim inner wall portion forming an inner perimeter of the rim portion; the rim outer wall portion comprises a rim outer wall upper sloped surface being positioned in an outside of an upper region of the rim outer wall portion and being sloped downward toward an outside of the bowl portion; and at least a part of the exterior part is disposed between an upper end and a lower end of the rim outer wall upper sloped surface; and wherein the rim inner wall portion includes:

a rim inner wall upper sloped surface being positioned in an inside of an upper region of the rim inner wall portion and being sloped downward toward an inner of the bowl portion; and a wall in a vertical cross section being formed to rise straightly from the top edge of the waste receiving surface to the rim inner wall upper sloped surface.

2. The flush toilet of claim 1, wherein in at least a part of an entire perimeter of the rim portion, a horizontal distance between a top end of the rim inner wall upper sloped surface and a bottom end of the rim inner wall upper sloped surface is formed to be longer than a horizontal distance between an top end of the rim outer wall upper sloped surface and a bottom end of the rim outer wall upper sloped surface.

3. The flush toilet of claim 1, wherein a bottom end of the rim inner wall upper sloped surface is disposed above a top end of the spouting portion.

4. The flush toilet of claim 2, wherein the rim inner wall upper sloped surface is formed in an arc shape;

the rim outer wall upper sloped surface is formed in an arc shape;

and a ratio between the radius of the arc forming the rim outer wall upper sloped surface and the radius of the arc forming the rim inner wall upper sloped surface is formed in a ranges from 1:2 to 1:5 inclusive.

5. The flush toilet of claim 1, wherein at least a part of the rim inner wall portion overhangs inward towards the bowl portion.

6. The flush toilet of claim 1, wherein an outlet of the spouting portion is formed in a front region of the bowl portion such that the flush water swirls from the front end of the bowl portion toward a rear of the bowl portion to generate the circulating current.

7. The flush toilet of claim 1, wherein the spouting portion is formed to spout to the front of the bowl portion, the rim portion has an upper portion that overhangs inwardly being disposed on the front side of an outlet of the spouting portion.

8. The flush toilet of claim 1, wherein the water conduit is configured to guide the flush water supplied by a flush water supply apparatus, the flush water supply apparatus being configured to use water utility supply pressure from a flush water source.

9. The flush toilet of claim 1, wherein a bottom end of at least part of the exterior part is disposed at a height below the height of the top surface of the rim portion.

* * * * *